US005715888A

United States Patent [19]

Kaell et al.

[11] Patent Number: 5,715,888

[45] Date of Patent: Feb. 10, 1998

[54] INGOT MOULD FOR CONTINUOUS CASTING

[75] Inventors: Norbert Kaell, Differdange; Andre Kremer, Leudelange; Rudy Petry, Muensbach; Michel Rinaldi, Bereldange, all of Luxembourg

[73] Assignee: Paul Wurth S.A., Luxembourg

[21] Appl. No.: 596,263

[22] PCT Filed: Aug. 5, 1994

[86] PCT No.: PCT/EP94/02600

§ 371 Date: Oct. 29, 1996

§ 102(e) Date: Oct. 29, 1996

[87] PCT Pub. No.: WO95/05910

PCT Pub. Date: Mar. 2, 1995

[30] Foreign Application Priority Data

Aug. 20, 1993 [LU] Luxembourg ..... 88 393

[51] Int. Cl.[6] ..... B22D 11/04

[52] U.S. Cl. ..... 164/416; 164/418

[58] Field of Search ..... 164/416, 478, 164/418

[56] References Cited

U.S. PATENT DOCUMENTS 4,483,385 11/1984 Kurzinski ..... 164/416

4,669,525 6/1987 Kurzinski ..... 164/478

*Primary Examiner*—Kuang Y. Lin

*Attorney, Agent, or Firm*—Fishman, Dionne, Cantor & Colburn

[57] ABSTRACT

An ingot mould for a continuous casting plant is described, comprising an ingot mould body (22), which defines an axial flow channel (18) for molten metal and which contains a circuit for cooling this axial flow channel (18). The ingot mould body (22) is surrounded, at least partially, by an outer casing (44) in which it is supported axially using a hydraulic/pneumatic suspension device, for example a cylinder with rotational symmetry whose axis of symmetry is coaxial with the casting axis. This hydraulic/pneumatic suspension device is preferably controlled by a hydraulic/pneumatic control system (72) designed to make the ingot mould body (22) oscillate about a reference position.

32 Claims, 4 Drawing Sheets

INGOT MOULD FOR CONTINUOUS CASTING

BACKGROUND OF THE INVENTION

The present invention relates to an ingot mould for a continuous casting plant.

In such an ingot mould for continuous casting, an ingot mould tube, serving as a flow channel for the molten metal, is vigorously cooled by a cooling circuit incorporated in the body of the ingot mould. In this way, the molten metal solidifies in contact with the inner wall of the ingot mould tube so as to form a peripheral crust. Now, the attachment or sticking of this peripheral crust to the inner wall of the ingot mould tube would risk tearing the crust. In order to prevent such an attachment or sticking of this peripheral crust to the inner wall with its harmful consequences, it is known that the ingot mould should be subjected to an oscillatory movement along the casting axis.

For this purpose, it is known how to support the ingot mould on an oscillating table, which is connected through one or more levers to a device for generating mechanical oscillations. The oscillation generating device and the lever or levers, which are quite bulky, are mounted below the oscillating table, laterally with respect to the casting axis. The presence of the oscillating table and the levers not only causes a problem as regards the available space, but it also increases the inertial mass to be set into oscillatory motion.

In order to understand the problems inherent in a device for setting an ingot mould for continuous casting into oscillation, it should be noted that an ingot mould for casting steel billets has—with its ingot mould tube, its ingot mould body, its cooling circuit filled with cooling liquid and possibly an electromagnetic inductor to agitate the molten metal—a weight which is easily of the order of 3 tonnes. It is necessary to be able to confer on this weight oscillations with an amplitude of a few millimeters, and with a frequency of the order of 5 Hz or higher. Now, the device generating the mechanical oscillations not only has to overcome the inertia of the ingot mould itself, but also has to deal with the inertia of the supporting mechanism (for example, the levers and oscillating table), as well as the frictional forces between the inner wall of the ingot mould tube and the molten metal. The greater the inertial masses, the greater the power needed to produce the oscillations of the ingot mould and the greater the stresses on the lever mechanism used to transmit the oscillatory motion to the ingot mould. The articulated joints of the transmission levers are particularly weak points, in view of the fact that they have to transmit large forces, while being subjected to relative movements of small angular amplitude but high frequency.

In order to overcome the aforesaid disadvantages, it has been proposed that the ingot mould should be supported in a supporting structure using peripheral leaf springs, thus creating a harmonic oscillator whose mass corresponds to that of the ingot mould. In order to produce forced oscillations in such a mechanical system, it is of course sufficient to apply to the ingot mould a much smaller force, since it is possible to take advantage of the resonance phenomenon at the natural frequency of the system. Thus, it has been proposed, for example, that the forced oscillations of an elastically supported ingot mould should be produced using a low power hydraulic cylinder which is mounted laterally between the ingot mould and its supporting structure. The axial guidance of the oscillatory motion and the compensation for the off-axis nature of the excitation force produced by the hydraulic cylinder are then achieved by an elaborate dimensioning of the various leaf springs. In practice, the dimensioning and positioning of the peripheral leaf springs, which must support the great weight of the ingot mould while giving the system the required elastic characteristic, may however pose problems. Moreover, the supporting structure, which surrounds the ingot mould and supports it through the intermediary of the said peripheral leaf springs, takes up considerable space around the ingot mould. This supporting structure, equipped with leaf springs, becomes particularly troublesome when it is necessary to work with an electromagnetic agitator which is replaceable and/or vertically movable.

SUMMARY OF INVENTION

The aim of the present invention is to propose an ingot mould which no longer has to be suspended in a mechanism with levers or in one with leaf springs to allow an oscillatory movement along the casting axis.

This aim is achieved by an ingot mould in which the ingot mould body is surrounded at least partially by an outer casing in which it is suspended axially using a hydraulic/pneumatic suspension device, which is directly connected between the external casing and the ingot mould body.

According to the present invention, the ingot mould body is supported either hydraulically or pneumatically in its external casing; i.e. through the intermediary of a suspension device involving either a pressurised liquid or a pressurised gas. Such a suspension device takes up far less space than leaf springs. Moreover, it is known how to modify its dynamic behaviour much more flexibly than the dynamic behaviour of a spring suspension. Thus, it is possible, for example, for a given suspension device, to vary the pressure or the nature of the suspension fluid in order to modify its dynamic behaviour. In this context, it is to be noted that a correction of the dynamic behaviour of a leaf spring suspension is possible only with difficulty. Hence the need to carry out very elaborate prior calculations for the dimensioning of leaf springs.

The ingot mould body, suspended hydraulically or pneumatically, could of course be connected to any type of device for generating mechanical oscillations, for example to a rotary motor with a cam or to a hydraulic cylinder. This mechanical oscillation generating device would then subject the ingot mould body to forced oscillations about a reference position, which is defined elastically by the hydraulic/pneumatic suspension device. It is, however, preferable to take advantage of the presence of the hydraulic/pneumatic suspension device in order to control it by a hydraulic/pneumatic control system designed to produce, preferably in a closed control loop, oscillations about a reference position. It will be appreciated that in this way a particularly compact ingot mould is obtained, without the involvement of levers and mechanical joints in the generation and transmission of the oscillatory motion. Such an ingot mould is also characterised by great flexibility and precision as regards the adjustment of the frequency, the form and the amplitude of the oscillations produced.

The hydraulic/pneumatic suspension device advantageously comprises an annular actuator having rotational symmetry, which is supported in the outer casing so as to have its central axis substantially coaxial with the casting axis. The ingot mould body is then supported axially in this annular actuator. A first advantage of this embodiment is that the forces generated by the annular actuator are, because of the rotational symmetry, applied axially to the ingot mould body, which avoids creating torques to be absorbed by axial guidance of the ingot mould body. It is to be noted that this advantage may also be obtained by providing several separate actuators around the ingot mould body, which are positioned and dimensioned so that the resultant of the forces applied to the ingot mould body is substantially coaxial with the casting axis. In comparison with this embodiment using several separate actuators, however, the annular actuator has the considerable advantage of having, for a small amount of occupied space, a large area exposed to the pressure of the suspension fluid, which makes it possible to work with relatively low pressures for the suspension fluid. In this context, it is also to be noted that it is entirely possible to use a gaseous suspension fluid, but that it is preferable to use a hydraulic liquid if a better dynamic response of the system for regulating the oscillatory motion is required.

With the aim of improving the dynamic response of the system, an annular double-action actuator is preferably chosen. The latter produces a hydraulic/pneumatic force which changes direction. With a single-action actuator the frictional forces during the downward motion should be overcome by the weight of the ingot mould body, possibly helped by one or more springs acting on the ingot mould body in the casting direction.

In a preferred embodiment of the ingot mould, the annular actuator comprises a first sleeve and a second sleeve, one of which is embedded in the other, and which are movable with respect to each other under the action of a pressurised fluid. The said first sleeve is attached to the said outer casing, and the said second sleeve is attached to the ingot mould body. One of the two sleeves then defines an annular piston which is axially movable in an annular chamber defined in the other sleeve. It is to be noted, however, that the use of an annular actuator having a segmented annular piston is not ruled out, each piston segment being movable in a separate chamber.

In a first variant of the embodiment, the annular piston delimits, in a sealed manner in the said annular chamber, an upper annular pressure chamber and a lower annular pressure chamber. It is to be noted that in a single-action annular actuator the upper annular pressure chamber is connected to the atmosphere.

In a second variant of the embodiment, the hydraulic/pneumatic suspension device comprises at least one body inflatable by a pressurised fluid which is interposed axially between a surface forming part of the outer casing and a surface forming part of the ingot mould body. This method, in which the inflatable body delimits a sealed pressure chamber, has the advantage of having fewer sealing problems to be solved than the variant of the embodiment described in the previous paragraph.

The hydraulic/pneumatic suspension device may comprise several inflatable bodies which are preferably positioned so that the resultant hydraulic/pneumatic force applied to the ingot mould body is substantially coaxial with the casting axis. It may, however, also comprise one annular inflatable body which surrounds the ingot mould body and whose axis of symmetry is coaxial with the casting axis.

In order to absorb reactions perpendicular to the casting axis, which are for example due to the extraction of the cast product from the ingot mould, it is recommended that means of guidance between the ingot mould body and its outer casing are provided. These means of guidance advantageously comprise a hydrostatic guidance device. The latter is more compact, experiences absolutely no wear, produces low friction and may have certain advantages as regards sealing. These latter advantages will be described in more detail in the description of the figures that follows.

The said means of guidance may also comprise, either as accessories or exclusively, mechanical means of guidance, for example guide rollers and/or guiding slides. This is advantageously the case if the casting axis is curved.

It will be appreciated that the outer casing advantageously forms external shielding for the ingot mould body, at least over the greater part of its height. The said hydraulic/pneumatic suspension device is then advantageously mounted between this shielding and the ingot mould body, in such a way as to be protected from splashes of molten metal and from mechanical impacts.

The ingot mould body preferably forms a unit which can be removed as a whole, which is designed to be introduced axially, preferably from the top through an opening for the passage of the hydraulic/pneumatic suspension device. In this way the ingot mould body may easily be replaced without having to remove the said hydraulic/pneumatic suspension device. The latter advantageously forms a unit which can be removed as a whole, which is designed to be introduced axially, preferably from the top, into a housing in the outer casing. In this way, it is possible, in the event of any problems, easily to exchange it for a replacement unit after having removed the ingot mould body.

It will also be appreciated that an electromagnetic inductor for agitating the molten metal may be installed on a supporting structure surrounding the outer casing. As a result of this, the mass of this inductor should not be set into oscillatory motion. An adjustment of the height of the inductor is still possible, and it is known how to remove the inductor upwards, if necessary.

BRIEF DESCRIPTION OF THE DRAWINGS

Additional advantages and characteristics of the invention will emerge from the detailed description of several embodiments given below, as illustrative examples, by referring to the appended drawings in which.

DETAILED DESCRIPTION OF THE PREFERRED EMBODIMENTS

Figure 2:
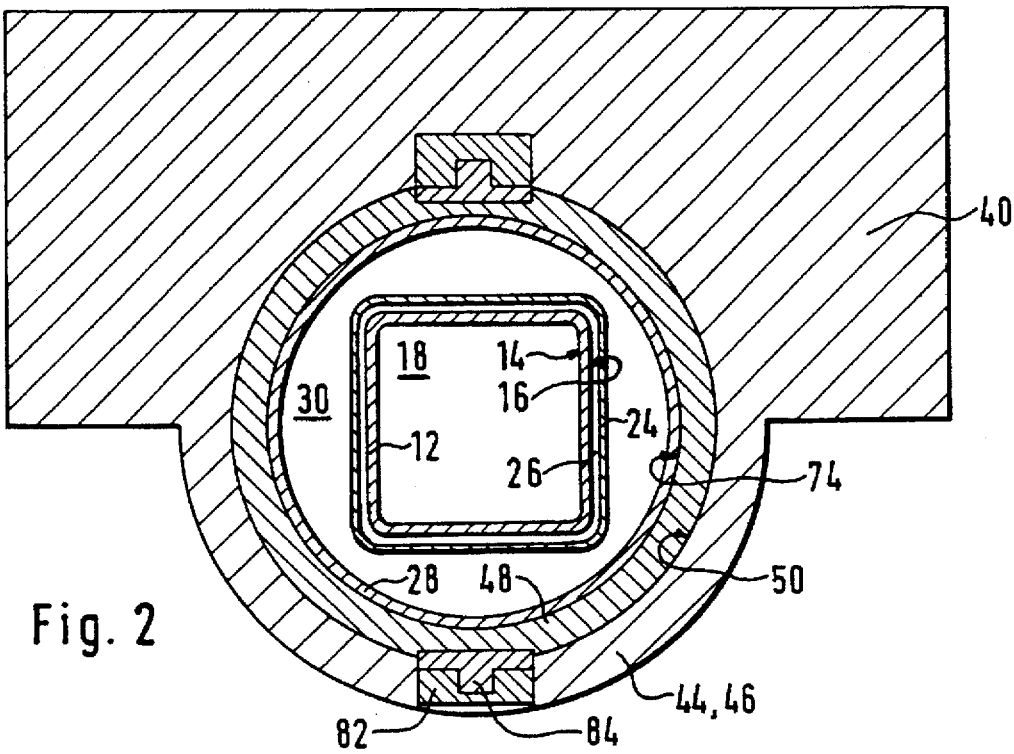
FIG. 2 is a transverse cross-section through an ingot mould according to the invention.
Figure 3:
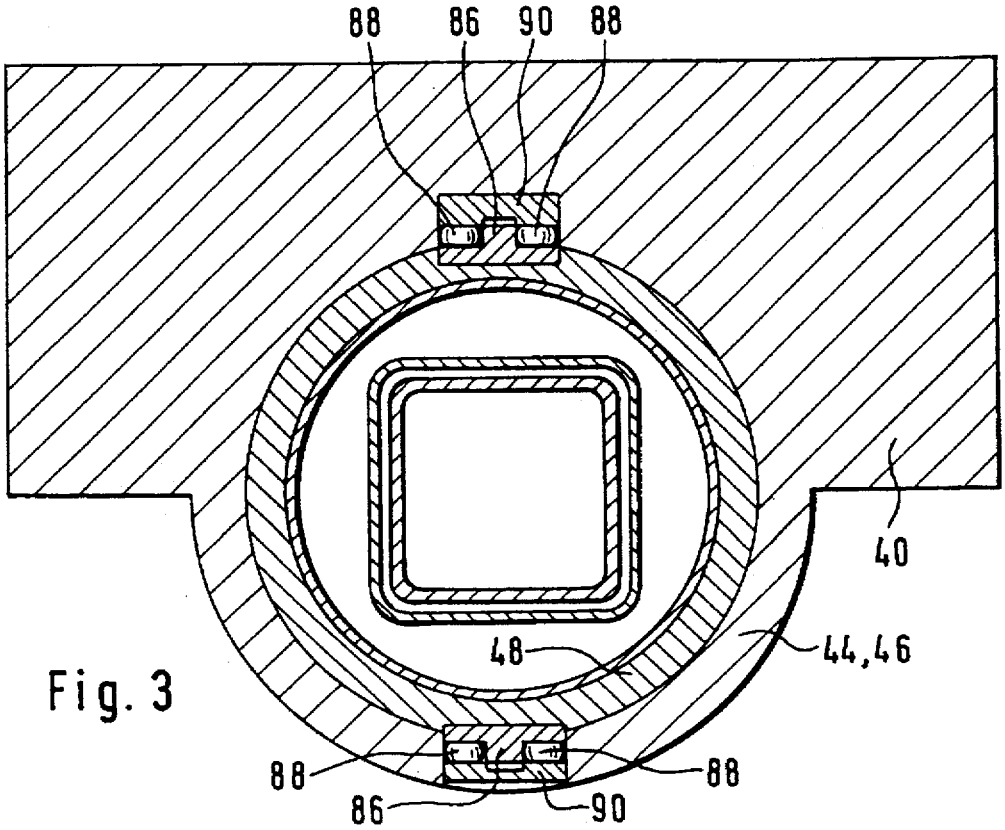
FIG. 3 is a transverse cross-section through another embodiment of an ingot mould according to the invention.

The figures show an ingot mould 10 used, for example, in the continuous casting of metal billets, steel billets for example. It comprises an ingot mould tube 12 having an inner wall 14 and an outer wall 16. The inner wall 14 defines a flow channel 18 for the molten steel. The reference number 20 denotes the central axis of this channel. This axis 20 may straight or curved; in the latter case, it most frequently describes a circular arc with a radius of several meters. The ingot mould tube is normally a thick-walled copper tube. Its internal cross-section defines the cross-section of the cast product. FIGS. 2 and 3 show a representation of a square cross-section; this cross-section could, however, also be rectangular, circular or could have any other shape. The arrow denoted by reference number 21 indicates the direction of flow of the molten steel through the ingot mould tube 12.

Figure 1:
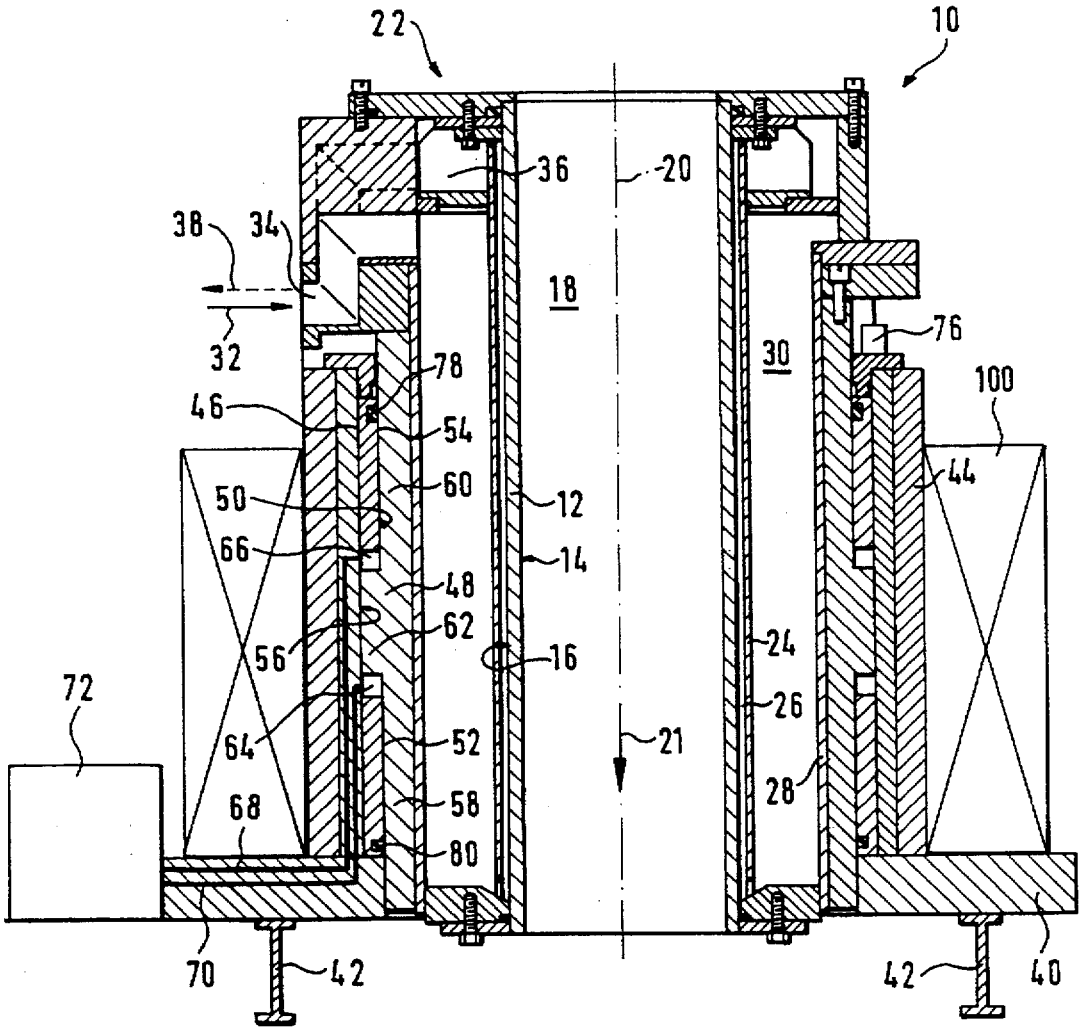
FIG. 1 is a longitudinal cross-section through a first embodiment of an ingot mould according to the invention.
Figure 4:
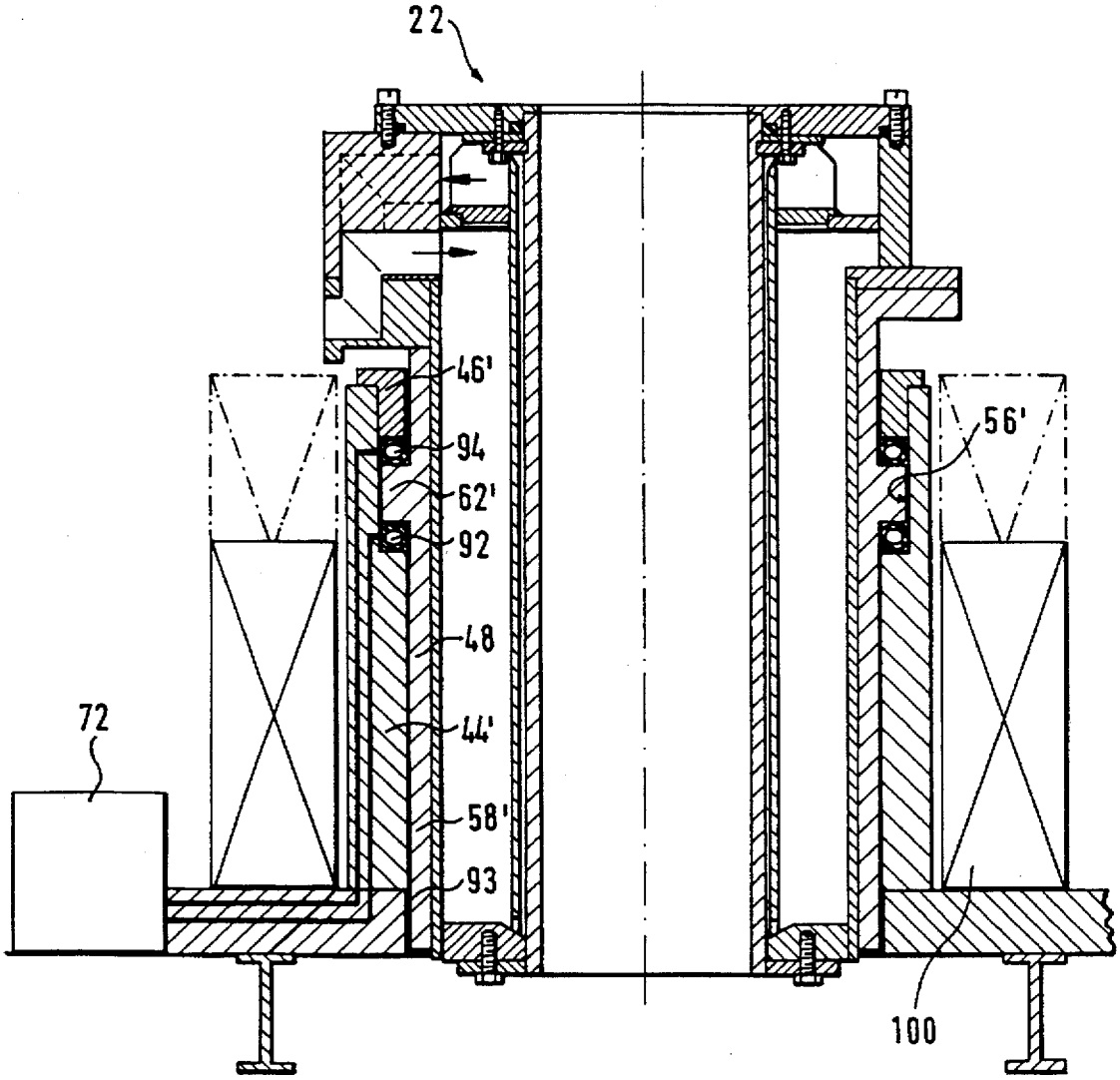
FIG. 4 is a longitudinal cross-section through another embodiment of an ingot mould according to the invention.

The ingot mould tube 12 is vigorously cooled in order to cause the molten steel in contact with its inner wall 14 to solidify. For this purpose, the said tube forms part of an ingot mould body 22, which contains a circuit for cooling the outer wall 16 of the ingot mould tube 12. The cooling circuit shown in FIGS. 1 and 4 is known per se. An inner jacket 24 surrounds the ingot mould tube 12 over almost the whole of its height, and forms, with the outer wall 16 of the said tube, a first annular space 26 defining a first very narrow annular cross-sectional channel for a cooling liquid. An outer jacket 28 on the ingot mould body 22 surrounds the inner jacket 24 and with the latter forms a second annular space 30, which surrounds the first annular space 26 and defines a significantly greater annular cross-sectional channel for the cooling liquid. A circuit for the supply of a cooling liquid is represented schematically by the arrow 32. The cooling liquid enters through a connector 34, located on the side of the upper end of the ingot mould 10, in the second annular space 30, passes through the said space 30, and enters the first annular space 26 at the lower end of the ingot mould 10. The cooling liquid passes through the very narrow cross-sectional channel of the first annular space 26 at high speed and in a direction opposite to that of the casting 21. This liquid is finally collected in an annular collector 36 located at the upper end of the ingot mould body 22. A circuit for the evacuation of the cooling liquid is represented schematically by the arrow 38.

It is to be noted that the ingot mould body 22, comprising the ingot mould tube 12 and the cooling circuit described above, preferably forms a unit which is removable as a whole and which is delimited on the outside, over the majority of its length, by the outer jacket 28. In FIGS. 2 and 3, this jacket has a circular cross-section. However, it is obvious that it could have a cross-section that is square, rectangular or any other geometrical shape.

In FIGS. 1 and 4, it can be seen that the ingot mould rests, with the help of a base 40, on a supporting structure, represented schematically by two beams which are denoted by the reference number 42. This base 40 forms, together with an outer casing 44, a supporting structure for the ingot mould body 22. It is to be noted that the outer casing 44 advantageously forms a kind of outer shielding for the lower end of the ingot mould 10. For this purpose, it has for example the shape of a hollow cylindrical section, which is mounted with one of its ends on the base 40 and which extends vertically to the upper end of the ingot mould body 22.

The ingot mould body 22 is supported hydraulically in the outer casing 44, preferably by an annular actuator with rotational symmetry surrounding the ingot mould body 22 in such a way that its axis of symmetry (or central axis) is coaxial with the casting axis.

This annular actuator, which preferably forms a unit removable as a whole, mainly comprises a first sleeve 46, located beside the outer casing 44, and a second sleeve 48, located beside the ingot mould body 22. The first sleeve 46 is mounted, preferably so that it is easily removable, in a housing in the outer casing 44. It has an axial channel 50, comprising a lower guide channel 52 and an upper guide channel 54. The two guide channels 52 and 54 are separated axially by an annular chamber 56. The second sleeve 48 has a lower end 58, which is set in the said lower guide channel 52, and an upper end 60, which is set in the said upper guide channel 54. At the level of the annular chamber 56, the second sleeve 48 defines an annular piston 62 in itself.

In the embodiment shown in FIG. 1, this annular piston 62 delimits, in the annular chamber 56 and in a sealed manner, a lower pressure chamber 64 and an upper pressure chamber 66. These pressure chambers 64 and 66 are connected by hydraulic ducting 68 and 70 to a hydraulic circuit 72. The latter is a hydraulic circuit 72 known per se, which enables the pressure of a hydraulic fluid in each of the ducts 68 and 70 to be made to pulsate. In this way, the said second sleeve 48 is subjected to an oscillatory hydrostatic force. The annular actuator is also advantageously equipped with a position sensor 76, represented schematically in FIG. 1. This position sensor 76 supplies the feedback signal making it possible to regulate the amplitude and frequency of the oscillations produced and a neutral position of the actuator in a closed control loop.

It is then possible to produce an oscillatory motion of the second sleeve 48 with respect to the first sleeve 46 whose frequency, form and, within the limits imposed by the maximum travel of the annular piston 62 in the annular chamber 56, amplitude of such motion can be adjusted. It is to be noted, in order to fix ideas, that frequencies of a few Hz and amplitudes of a few mm are normal values.

The second sleeve 48 itself incorporates an axial channel 74, receiving the ingot mould body 22. The latter may be introduced axially from the top into this axial channel 74. It is to be noted that, when installed, the ingot mould body 22 rests, with a shoulder at its upper end, on a corresponding shoulder at the upper end of the said second sleeve 48. It follows that the ingot mould body 22 is suspended in the second sleeve 48 and may easily be removed in order to replace it.

It will be appreciated that it is possible to work with a reduced pressure in order to support the ingot mould body 22 hydrostatically and in order to overcome the friction between the ingot mould tube 12 and the cast product. In effect, the annular working area defined by the annular piston 62 in the pressure chambers 64 and 66 is far from being negligible. In some cases, it may be advantageous for the annular piston 62 to define in the lower pressure chamber 64 larger working cross-section than that in the upper pressure chamber 66. This difference between the working areas of the piston 62 may, for example, be fixed in such a way that the ingot mould body 22 is supported hydrostatically when the pressure in the lower and upper pressure chambers 64 and 66 is equal to a nominal pressure. It will be appreciated that several methods are proposed for guiding the axial motion of the ingot mould body 22.

A first variant of the embodiment of a guidance system is described with the help of FIG. 1. In this variant of the embodiment, the lower guide channel 52 or the upper guide channel 54 of the first sleeve 46 cooperate respectively with the lower end 58 or the upper end 60 of the second sleeve 48 to form a hydrostatic guide for the second sleeve 48 in the first sleeve 46. This may be, for example, a hydraulic guidance system with a wedge-shaped annular joint as shown schematically in FIG. 1 or a hydraulic guidance system with multiple axial pockets which are spaced out around the circumference in the surfaces delimiting the lower and upper guide channels 52 and 54. One advantage of such a hydraulic guidance system is that the problem of the axial sealing of the pressure chambers 64 and 66 is elegantly solved. The pressurised fluid used to create the hydraulic guidance is drained on one side from the annular chamber 56 and on the other side respectively from an upper annular channel 78 or a lower annular channel 80, which are connected to a reservoir (not shown). In this way, the hydraulic guidance of the second sleeve 48 forms at the same time sealed upper and lower hydraulic joints respectively, for the annular chamber 56.

A second variant of the embodiment of a guidance system is shown in FIG. 2. This is a slide/runner assembly. The slides 82 are, for example, attached to the first sleeve 46 and the runners 84 to the second sleeve 48. Preferably, two diametrically opposite slide/runner assemblies (82, 84) are provided both at the upper edge and at the lower edge of the outer casing 44. The variant of the embodiment shown in FIG. 3 differs from that in FIG. 2 by the use of a roller/rail assembly replacing the runner/slide assembly. The rail 86 is preferably attached to the second sleeve 48, while a plate 90 supporting the guide rollers 88 is fixed, preferably outside, on the outer casing 44. It is to be noted that, with mechanical guidance of the oscillatory motion, it is easy to define a curved axis for the movement, for example a circular path for the motion having a radius of a few meters.

FIG. 4 represents a variant of the embodiment of the pressure chambers. Instead of delimiting the latter in a sealed manner by the annular piston 62 inside the annular chamber 56 and providing sealing units at the two input sections of the annular chamber 56, the embodiment of FIG. 4 operates with inflatable bodies defining sealed pressure chambers. These may be, for example, inflatable cushions or tubes or inflatable diaphragms. A first inflatable body 92 is interposed axially between the annular piston 62', which no longer needs to fulfil the sealing function, and the frontal surface which delimits the annular chamber 56' axially towards the bottom. A second inflatable element 94 is interposed axially between the annular piston 62' and the frontal surface which delimits the annular chamber 56' axially towards the top. In the case of diaphragms, the latter are embedded in a sealed manner either in the annular piston 62' or in the frontal surfaces which axially delimit the annular chamber 56'. The inflatable elements 92 and 94 are connected to the hydraulic circuit 72. Their deformation by pulsation of the pressurised fluid produces the required oscillations. The variant of the embodiment shown in FIG. 4 has the advantage that all the problems related to the axial sealing of the actuator are avoided. A direct consequence is that it is possible to work with less precise adjustments between the elements capable of moving with respect to each other, as long as the axial guidance of the oscillatory motion is satisfactorily provided for. In FIG. 4, it can be seen, for example, that the sleeve 46' extends only as far as the upper end of the outer casing 44'. The lower end 58' of the second sleeve 48 is guided in a guide ring 93, which is mounted directly in the outer casing 44 or in the base 40. The annular chamber 56' is formed by cooperation between the sleeve 46' and the surface of a shoulder on the outer casing 44'.

FIGS. 5 to 8 are schematic illustrations of a few additional variants of the embodiment.

Figure 5:
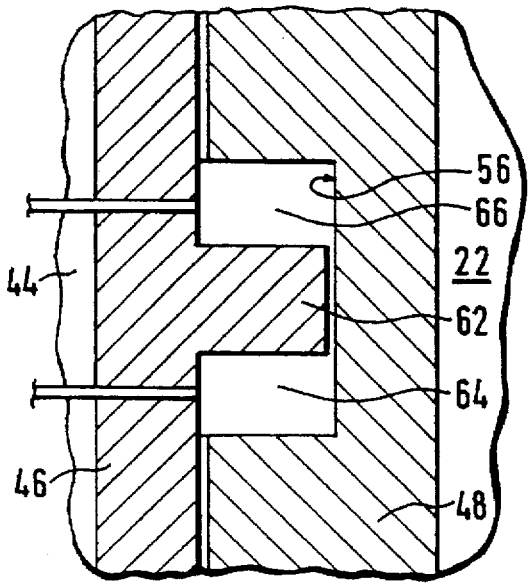
FIGS. 5 and 6 are schematic representations, in transverse cross-sections, of details of additional variants of the embodiment of an ingot mould according to the invention.

In FIG. 5, the annular piston 62 is attached to the said first sleeve 46, supported by the outer casing 44. The annular chamber 56 is defined by the said second sleeve 48, supporting the ingot mould body 22.

Figure 6:
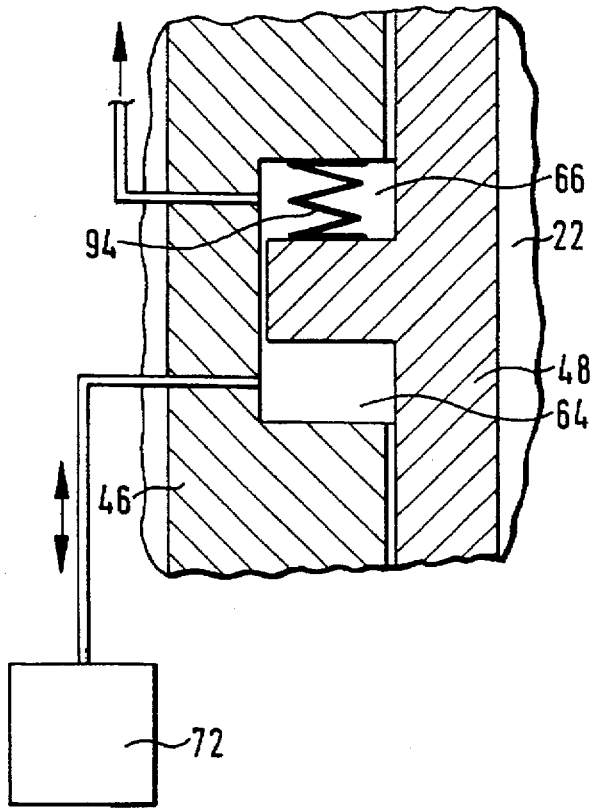

In FIG. 6, the lower pressure chamber 64 is connected to the hydraulic circuit 72, while the upper pressure chamber 66 is connected to atmospheric pressure. The actuator forms a single-action actuator, and the weight of the ingot mould body produces the downward motion. The action of gravity may be reinforced by springs or other elastic elements, which are connected between the ingot mould body 22 and its supporting structure so as to produce an elastic force in the direction of casting 21. In FIG. 6, these springs are represented schematically by the symbol denoted by the reference number 94. It is to be understood that these springs are not necessarily incorporated into the actuator.

Figure 7:
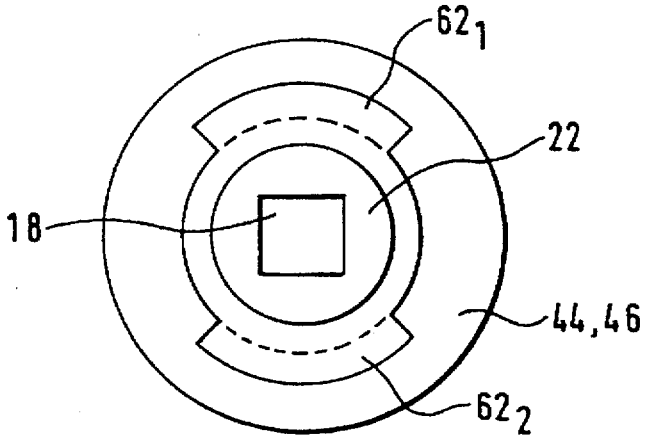
FIG. 7 is a schematic representation, in a transverse cross-section, of an additional variant of the embodiment of an ingot mould according to the invention.

FIG. 7 represents a variant of the embodiment in which the annular piston is replaced by two piston segments $62_1$ and $62_2$ surrounding the ingot mould body 22 over only a part of its circumference. It is to be noted that a plane of symmetry passing through the two piston segments $62_1$ and $62_2$ advantageously contains the (curved) casting axis 20. This characteristic makes it possible to create, through a pressure difference acting on the pistons $62_1$ and $62_2$, a torque which partly (or even completely) compensates for the torque exerted by the cast product on the ingot mould body 22.

In FIGS. 1 to 4, the reference number 100 denotes an inductor used to agitate the molten metal electromagnetically in the channel 18. This inductor 100 surrounds the casing 44 and is, for example, supported by the base 40. It will be appreciated that it may be displaced axially along the casing 44 and that it may be withdrawn to the top of the ingot mould 10. The inductor 100 does not participate in the oscillatory motion of the ingot mould body 22.

We claim:

1. Ingot mold assembly for a continuous casting plant comprising:

an ingot mold body, including a flow channel for a molten metal and an internal cooling circuit for cooling the molten metal in said flow channel;

an external casing surrounding at least partially said ingot mold body; and a hydraulic or pneumatic suspension device for suspending said ingot mold body in said external casing, wherein said hydraulic or pneumatic suspension device annularly surrounds said ingot mold body in said external casing.

2. Ingot mold assembly according to claim 1, including a hydraulic or pneumatic control system for controlling said suspension device, so as to make said ingot mold body, which is suspended in said suspension device, oscillate about a reference position.

3. Ingot mold assembly according to claim 1, wherein said suspension device comprises an annular actuator with rotational symmetry, which has its axis of symmetry substantially coaxial with the central axis of said flow channel, when said ingot mold body is suspended in said suspension device.

4. Ingot mold assembly according to claim 3, wherein said annular actuator is a double-action actuator.

5. Ingot mold assembly according to claim 3, wherein said annular actuator comprises a first sleeve and a second sleeve, which are movable with respect to each other under the action of a pressurized fluid, said first sleeve being supported by said outer casing, and a shoulder of said ingot mold assembly resting on said second sleeve.

6. Ingot mold assembly according to claim 5, wherein one of two sleeves defines an annular piston which is axially movable in an annular chamber defined in the other sleeve.

7. Ingot mold assembly according to claim 6, wherein said annular piston delimits, in a sealed manner in said annular chamber, an upper annular pressure chamber and/or a lower annular pressure chamber.

8. Ingot mold assembly according to claim 1, wherein said suspension device comprises at least one body inflatable by a pressurized fluid.

9. Ingot mold assembly according to claim 8, wherein said suspension device comprises several inflatable bodies which are positioned so that the resultant of the hydraulic or pneumatic forces applied to said ingot mold body is substantially coaxial with the central axis of said flow channel.

10. Ingot mold assembly according to claim 8, wherein said suspension device comprises at least one annular inflatable body surrounding said ingot mold body.

11. Ingot mold assembly according to claim 1, comprising guiding means positioned between said ingot mold body and said outer casing so as to guide said ingot mold body in said outer casing.

12. Ingot mold assembly according to claim 11, wherein said guiding means comprises guide rollers.

13. Ingot mold assembly according to claim 11, wherein said guiding means comprises guiding slides.

14. Ingot mold assembly according to claim 1, wherein said outer casing forms an external shielding for said ingot mold body, said hydraulic or pneumatic suspension device being mounted between said shielding and said ingot mold body.

15. Ingot mold assembly according to claim 1, wherein said suspension device forms a unit which can be removed as a whole out of said outer casing.

16. Ingot mold assembly according to claim 1, including an electromagnetic inductor for agitating the molten metal, said inductor surrounding said outer casing.

17. Ingot mold assembly for a continuous casting plant comprising:

an ingot mold body, including a flow channel for a molten metal and an internal cooling circuit for cooling the molten metal in said flow channel, said ingot mold body having a shoulder at its upper end, an external casing surrounding at least partially said ingot mold body, a hydraulic or pneumatic suspension device mounted in said external casing, wherein said ingot mold body rests with its shoulder on said suspension device when suspended in said suspension device and is removable as a unit out of said suspension device.

18. Ingot mold assembly according to claim 17, including a hydraulic or pneumatic control system for controlling said suspension device, so as to make said ingot mold body, which is suspended in said suspension device, oscillate about a reference position.

19. Ingot mold assembly according to claim 17, wherein said suspension device comprises an annular actuator with rotational symmetry, which has its axis of symmetry substantially coaxial with the central axis of said flow channel, when said ingot mold body is suspended in said suspension device.

20. Ingot mold assembly according to claim 19, wherein said annular actuator is a double-action actuator.

21. Ingot mold assembly according to claim 19, wherein said annular actuator comprises a first sleeve and a second sleeve, which are movable with respect to each other under the action of a pressurized fluid, said first sleeve being supported by said outer casing, and said shoulder of said ingot mold assembly resting on said second sleeve.

22. Ingot mold assembly according to claim 21, wherein one of the two sleeves defines an annular piston which is axially movable in an annular chamber defined in the other sleeve.

23. Ingot mold assembly according to claim 22, wherein said annular piston delimits, in a sealed manner in said annular chamber, an upper annular pressure chamber and/or a lower annular pressure chamber.

24. Ingot mold assembly according to claim 17, wherein said suspension device comprises at least one body inflatable by a pressurized fluid.

25. Ingot mold assembly according to claim 17, wherein said suspension device comprises several inflatable bodies which are positioned so that the resultant of the hydraulic or pneumatic forces applied to said ingot mold body is substantially coaxial with the central axis of said flow channel.

26. Ingot mold assembly according to claim 17, wherein said suspension device comprises at least one annular inflatable body surrounding said ingot mold body.

27. Ingot mold assembly according to claim 17, comprising guiding means positioned between said ingot mold body and said outer casing so as to guide said ingot mold body in said outer casing.

28. Ingot mold assembly according to claim 27, wherein said guiding means comprises guide rollers.

29. Ingot mold assembly according to claim 27, wherein said guiding means comprises guiding slides.

30. Ingot mold assembly according to claim 27, wherein said outer casing forms an external shielding for said ingot mold body, said hydraulic or pneumatic suspension device being mounted between said shielding and said ingot mold body.

31. Ingot mold assembly according to claim 17, wherein said suspension device forms a unit which can be removed as a whole out of said outer casing.

32. Ingot mold assembly according to claim 17, including an electromagnetic inductor for agitating the molten metal, said inductor surrounding said outer casing.

* * * * *